US009328571B2

(12) United States Patent
Taggart

(10) Patent No.: US 9,328,571 B2
(45) Date of Patent: May 3, 2016

(54) WELL HEAD WRENCH

(71) Applicant: Rangeland Drilling Automation Inc., High River (CA)

(72) Inventor: Mark Charles Taggart, High River (CA)

(73) Assignee: Prostar Manufacturing Inc., Okotoks (CA)

( * ) Notice: Subject to any disclaimer, the term of this patent is extended or adjusted under 35 U.S.C. 154(b) by 0 days.

(21) Appl. No.: 14/038,517

(22) Filed: Sep. 26, 2013

(65) Prior Publication Data

US 2014/0096651 A1 Apr. 10, 2014

Related U.S. Application Data

(60) Provisional application No. 61/706,025, filed on Sep. 26, 2012.

(51) Int. Cl.

| | |
|---|---|
| ***B25B 17/00*** | (2006.01) |
| ***E21B 19/16*** | (2006.01) |
| ***E21B 33/03*** | (2006.01) |

(52) U.S. Cl.

CPC ..... *E21B 19/163* (2013.01); *E21B 33/03* (2013.01); *E21B 19/16* (2013.01); *E21B 19/164* (2013.01)

(58) Field of Classification Search

CPC ..... E21B 19/164; E21B 19/163; E21B 19/16
USPC ..... 81/57.18, 57.2, 57.34
See application file for complete search history.

(56) References Cited

U.S. PATENT DOCUMENTS

| | | | | |
|---|---|---|---|---|
| 4,250,773 | A * | 2/1981 | Haynes et al. | 81/57.18 |
| 4,648,292 | A * | 3/1987 | Haynes et al. | 81/57.16 |
| 4,688,453 | A * | 8/1987 | Schulze-Beckinghausen | 81/57.18 |
| 4,895,056 | A * | 1/1990 | Schulze-Beckinghausen | 81/57.17 |
| 5,044,232 | A * | 9/1991 | Schulze-Beckinghausen | 81/57.18 |
| 5,150,642 | A * | 9/1992 | Moody et al. | 81/57.2 |
| 5,868,045 | A * | 2/1999 | Hauk | 81/57.34 |
| 6,439,807 | B1 * | 8/2002 | Wijsman | 405/170 |
| 7,707,914 | B2 * | 5/2010 | Pietras et al. | 81/57.16 |
| 8,733,213 | B2 * | 5/2014 | Taggart | 81/57.11 |
| 2013/0255446 | A1 * | 10/2013 | Taggart | 81/57.11 |

FOREIGN PATENT DOCUMENTS

WO 2008/022424 A1 2/2008

* cited by examiner

*Primary Examiner* — Hadi Shakeri
*Assistant Examiner* — Danny Hong
(74) *Attorney, Agent, or Firm* — Christensen O'Connor Johnson Kindness PLLC

(57) ABSTRACT

A wrench for unthreading a well head flange from a pipe is provided. The wrench can include a pipe jaw for gripping the pipe, and a torque arm assembly for applying rotational force to the well head flange. The assembly can include a torque arm wherein one end of the torque arm can be pivotally attached to a bolt hole disposed through the well head flange. Extending a cylinder disposed between the assembly and to an opposing end of the torque arm can cause the torque arm contact and rotate the well head flange relative to the pipe.

12 Claims, 6 Drawing Sheets

WELL HEAD WRENCH

CROSS-REFERENCE TO RELATED APPLICATIONS

This application claims the benefit of U.S. Provisional Patent Application No. 61/706,025 filed Sep. 26, 2012, which is incorporated by reference into this application in its entirety.

TECHNICAL FIELD

The present disclosure is related to the field of tools for use on a well, in particular, portable hydraulic-powered wrenches for removing well head flanges from a well head.

BACKGROUND

When performing service on well heads, it can be necessary to remove a well head flange, or well head component having a flange, threaded onto a tubular or pipe. Such threaded connections can be very difficult to undo if threads become rusted or seized together. To undo such connections can often require torque forces in the hundreds or even thousands of foot-pounds to break the threaded connection. Undoing such connections can be difficult or dangerous for personnel using convention methods and tools.

It is, therefore, desirable to provide a well head wrench that can undo a threaded flange connection easily and safely.

SUMMARY

A wrench for unthreading a well head flange from a pipe is provided. In some embodiments, the wrench can comprise a pipe jaw for gripping the pipe, and a torque arm assembly for applying rotational force to the well head flange. The wrench can comprise a first extendable cylinder operatively coupled to the pipe jaw to grip and release the pipe. The assembly can further comprise a torque arm having one end thereof pivotally attached to a bolt hole disposed through the well head flange. The wrench can further comprise a second extendable cylinder disposed between the assembly and to an opposing end of the torque arm. Extending the second cylinder can cause a knuckle disposed on the torque arm to contact and rotate the well head flange relative to the pipe. The torque arm can further comprise a flange block pivotally disposed on the knuckle. After a first extension of the second cylinder to rotate the well head flange, the second cylinder can be retracted to pull the torque arm away from the well head flange. The flange block can then be pivoted on the knuckle to be disposed between the torque arm and the well head well to permit a second extension of the second cylinder wherein the flange block can contact the well head flange whereupon the well head flange can be further rotated such that the threaded joint between the well head flange and the pipe has been sufficiently loosened. At this point, the first and second cylinders can be retracted so that the flange block can be removed from the well head flange and that the pipe can be released from the pipe jaw whereupon the well head flange can then be further unthreaded from the pipe by hand.

Broadly stated, in some embodiments, a wrench for unthreading a well head flange from a pipe, the wrench comprising: a frame further comprising a pipe jaw configured for gripping the pipe beneath the well head flange; means for operating the pipe jaw to grip and release the pipe; a torque arm assembly pivotally attached to the frame, the torque arm assembly configured to rotate the well head flange relative to the pipe when the jaw is gripping the pipe, the torque arm assembly further comprising a torque arm configured to pivotally and releasably attach to the well head flange; and means for applying force to the torque arm to rotate the well head flange relative to the pipe.

Broadly stated, in some embodiments, the pipe jaw can further comprise a fixed jaw disposed in the frame, and a sliding jaw slidably disposed in the frame and configured to slide within the frame towards and away from the fixed jaw to grip and release the pipe.

Broadly stated, in some embodiments, each of the fixed jaw and the sliding jaw can comprise at least one die insert plate, the at least one die insert plate configured for receiving and retaining at least one replaceable pipe die configured for gripping the pipe.

Broadly stated, in some embodiments, each of the fixed jaw and the sliding jaw can comprise two die insert plates.

Broadly stated, in some embodiments, the means for operating the pipe jaw can comprise a first telescoping member disposed in the frame, wherein the first telescoping member can further comprise a first end operatively coupled to the frame and a second end operatively coupled to the sliding jaw whereupon extending the first telescoping member can cause the sliding jaw to move towards the fixed jaw, and whereupon retracting the first telescoping member can cause the sliding jaw to move away from the fixed jaw.

Broadly stated, in some embodiments, the first telescoping member can further comprise one or more from a group consisting of a hydraulically-operated cylinder and a pneumatically-operated cylinder.

Broadly stated, in some embodiments, the torque arm can further comprise a yoke configured for releasable and rotatable attachment to the well head flange.

Broadly stated, in some embodiments, the torque arm can further comprise a knuckle configured for contacting and applying force to the well head flange.

Broadly stated, in some embodiments, the torque arm can further comprise a flange block rotatably attached to the knuckle, wherein the flange block can be configured to rotate on the torque arm and contact the well head flange to apply force thereto.

Broadly stated, in some embodiments, the means for applying force to the torque arm can comprise a second telescoping member disposed between the torque arm assembly and the torque arm whereupon extending the second telescoping member can cause the torque arm to apply force to rotate the well head flange when the torque arm is pivotally attached to the well head flange, and whereupon retracting the second telescoping member can cause the torque arm to stop applying force to the well head flange.

Broadly stated, in some embodiments, the second telescoping member can further comprise one or more from a group consisting of a hydraulically-operated cylinder and a pneumatically-operated cylinder.

Broadly stated, in some embodiments, the wrench can further comprise means for powering the means for operating the pipe jaw and the means for applying force to the torque arm.

Broadly stated, in some embodiments, the powering means can further comprise one or more from a group consisting of a pressurized hydraulic fluid supply system and a pressurized air supply system.

Broadly stated, in some embodiments, a method is provided for unthreading a well head flange from a pipe, the method comprising the steps of: providing a wrench further comprising; a frame further comprising a pipe jaw configured for gripping the pipe beneath the well head flange, means for operating the pipe jaw to grip and release the pipe, a torque arm assembly pivotally attached to the frame, the torque arm assembly configured to rotate the well head flange relative to the pipe when the jaw is gripping the pipe, the torque arm assembly further comprising a torque arm configured to pivotally and releasably attach to the well head flange, and means for applying force to the torque arm to rotate the well head flange relative to the pipe; placing the wrench in proximity to the pipe and gripping the pipe with the pipe jaw; attaching the torque arm to the well head flange; attaching the torque arm assembly to the torque arm; and applying force to the torque arm to rotate the well head flange relative to the pipe.

Broadly stated, in some embodiments, the above method can further comprise the steps of: retracting the torque arm from the well head flange; rotating a flange block disposed on the torque arm wherein the flange block is configured to contact and apply force to the well head flange; and applying force to the torque arm to rotate the well head flange relative to the pipe.

DETAILED DESCRIPTION OF EMBODIMENTS

Figure 1:
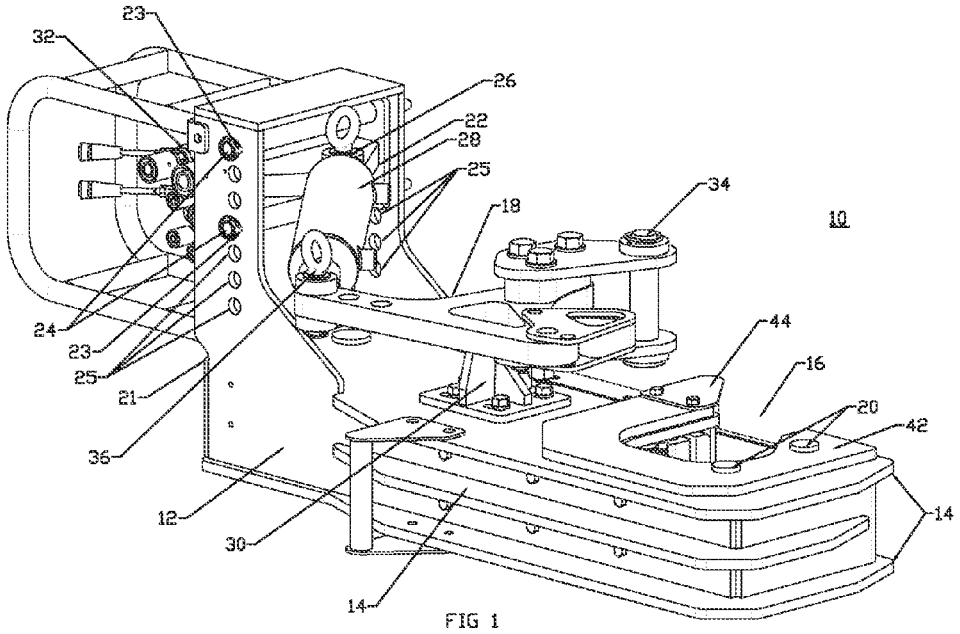
FIG. 1 is a perspective view depicting one embodiment of a well head wrench.

A well head wrench, and method for using the same is provided herein. Referring to FIGS. 1 to 5, one embodiment of well head wrench 10 is shown. In some embodiments, well head wrench 10 can comprise frame 12 having reinforcement 14 disposed on a side and front wall thereof. In some embodiments, well head wrench 10 can comprise torque arm assembly 17, which can further comprise cylinder mount assembly 21, further comprising cylinder base 22 attached thereto by having pins 24 passing through holes 25 of cylinder mount assembly 21, which can further secured in place by cotter pins 23. In some embodiments, torque arm assembly 17 can comprise torque arm cylinder 28 pivotally attached to cylinder base 22 via cylinder pin 26 at one end of cylinder 28, and the other end of cylinder 28 can be pivotally attached to torque arm 18 with torque arm pin 36. In some embodiments, well head wrench 10 can comprise jaw 16 for receiving a pipe. Jaw 16 can further comprise fixed jaw 38 attached to well head wrench 10 via pins 20, and sliding jaw 40. In some embodiments, well head wrench 10 can further comprise top plate 42 to further strengthen the frame of well head wrench 10. Well head wrench can also comprise one or more handles 44 attached thereto. In some embodiments, well head wrench 10 can further comprise lifting lug 30 attached to the top of frame 12, to enable well head wrench 10 to be lifted to or from a well head with a lifting hoist or hook disposed on the well platform.

Figure 3:
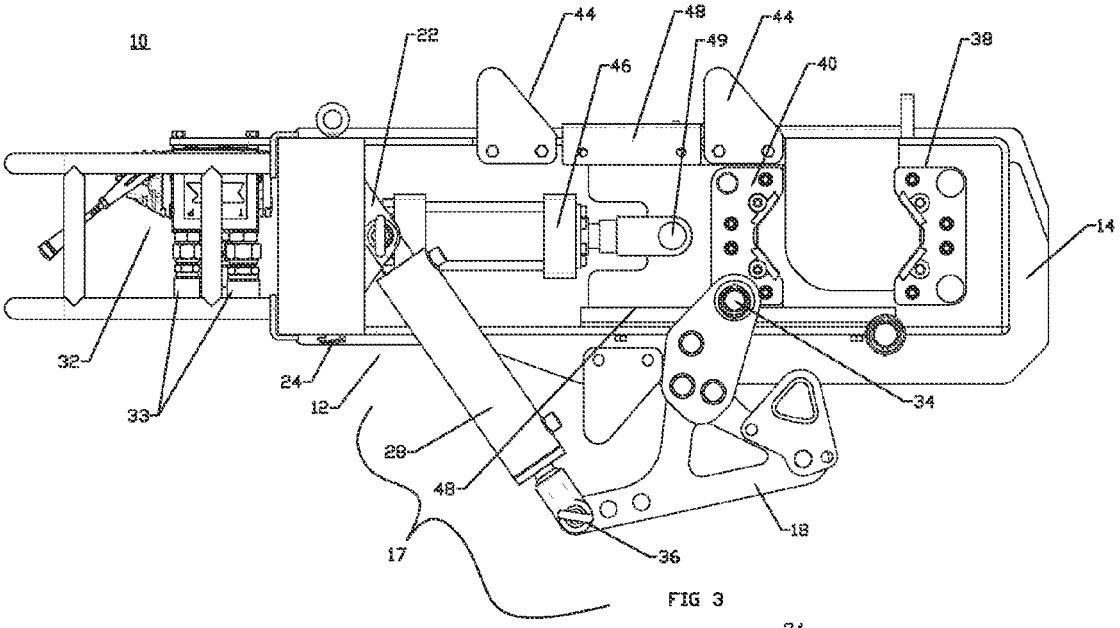
FIG. 3 is a top plan view depicting the well head wrench of FIG. 2 with the top cover removed.
Figure 4:
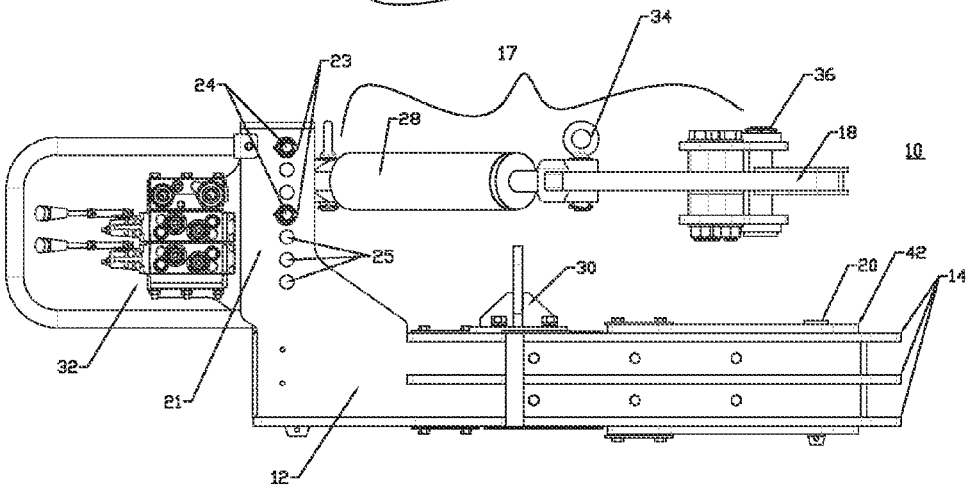
FIG. 4 is a side elevation view depicting the well head wrench of FIG. 1.
Figure 5:
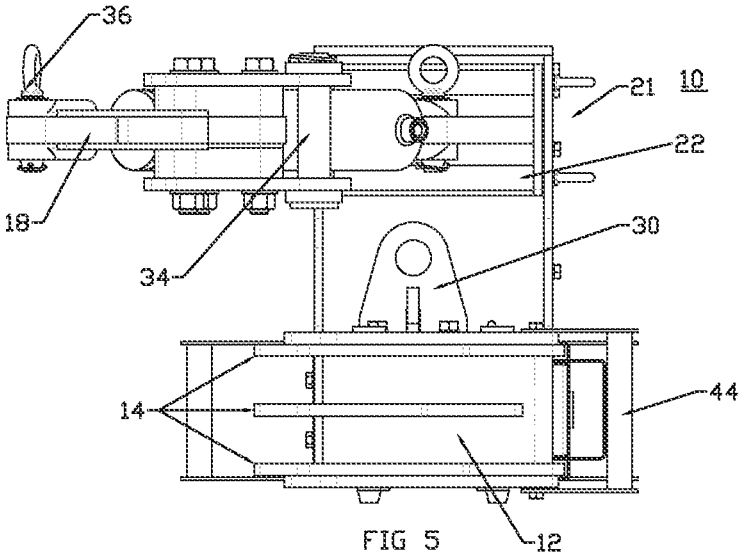
FIG. 5 is a front elevation view depicting the well head wrench of FIG. 1.

Referring to FIG. 3, well head wrench 10 is shown with the top of frame 12 removed to illustrate sliding jaw 40 slidably disposed in slider tracks 48 disposed within frame 12. In some embodiments, well head wrench 10 can further comprise a telescoping member for moving sliding jaw 40 along slider track 48 towards or away from fixed jaw 38 upon extending or contracting the telescoping member, respectively. In some embodiments, the telescoping member can comprise jaw cylinder 46 attached, at one end, to sliding jaw 40 via ram pin 49, and attached to cylinder base 22, at the other end, via cylinder pin 26. In some embodiments, jaw cylinder 46 can comprise a hydraulically-operated cylinder or ram. In other embodiments, jaw cylinder 46 can comprise a pneumatically-operated cylinder or ram.

Figure 6:
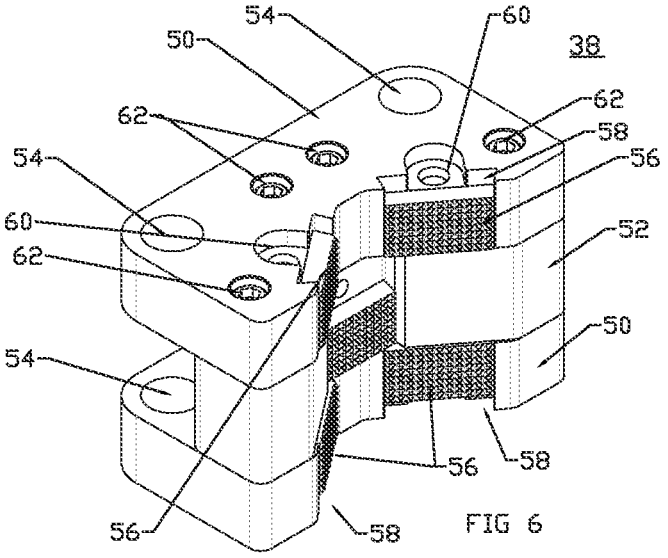
FIG. 6 is a perspective view depicting one embodiment of a fixed jaw of the well head wrench of FIG. 1.
Figure 7:
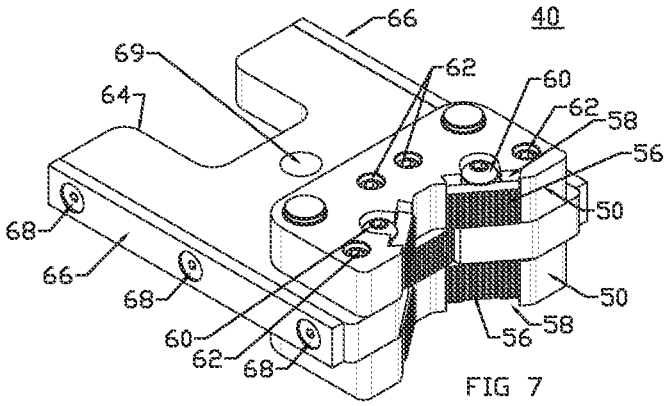
FIG. 7 is a perspective view depicting one embodiment of a sliding jaw of the well head wrench of FIG. 1.

Referring to FIGS. 6 and 7, one embodiment of the jaws used in well head wrench 10 are shown. In FIG. 6, one embodiment of fixed jaw 38 is shown. Fixed jaw 38 can comprise a base plate 52 sandwiched between two die insert plates 50, which can be identical. In some embodiments, die insert plate 50 can comprise die insert slots 58 configured to receive pipe die 56, which can be further secured to die insert plate 50 by fasteners 60. Pipe dies 56 can be configured with grooves, knurling, teeth, or any combination thereof for gripping a pipe.

Figure 2:
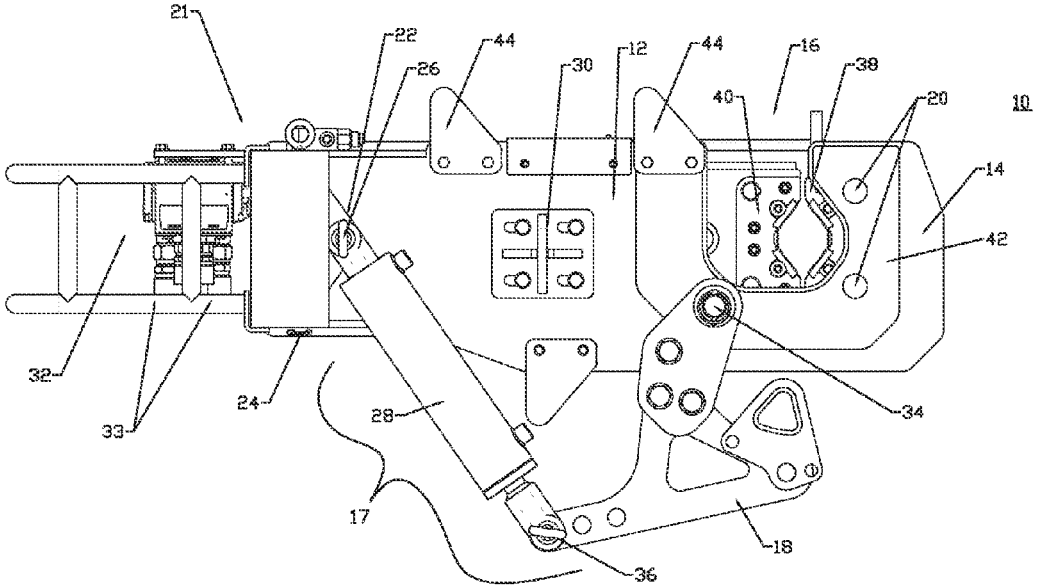
FIG. 2 is a top plan view depicting the well head wrench of FIG. 1.

In some embodiments, die insert plates 50 can be attached to base plate 52 with threaded fasteners 62. In further embodiments, die insert plates 50 can further comprise holes 54 configured to receive pins 20 to secure fixed jaw 38 to well head wrench 10, as shown in FIGS. 1 and 2. As pipe die 56 wear out, they can be replaced with by removing fasteners 60, taking out the worn pipe die 56 from die insert slots 58, and inserting a new pipe die 56 into pipe die slot 58, and then fastening fasteners 60 back into die insert plate 50.

In FIG. 7, one embodiment of sliding jaw 40 is shown. In some embodiments, sliding jaw 40 can comprise base plate 64 having die insert plates 50 disposed on top and below thereof, similar to fixed jaw 38. Die insert plates 50 can be attached to base plate 64 with threaded fastener 62, as well known to those skilled in the art. In some embodiments, sliding jaw 40 can further comprise slide rails 66 disposed on each side thereof, and fastened to sliding jaw 40 with threaded fastener 68. Pipe dies 56 for sliding jaw 40 can similarly be replaced once worn as for fixed jaw 38.

Figure 8:
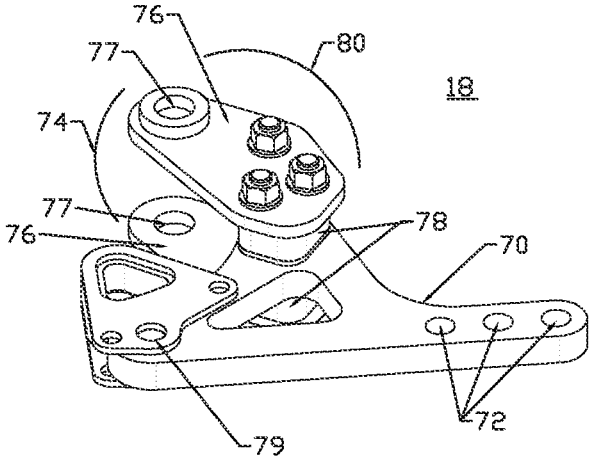
FIG. 8 is a perspective view depicting one embodiment of a torque arm of the well head wrench of FIG. 1.

Referring to FIG. 8, one embodiment of torque arm 18 is shown. In some embodiments, torque arm 18 can comprise torque arm plate 70 assembled between spacers 78 and flange plates 76, which can all be fastened together with threaded fasteners 80 as well known to those skilled in the art, to form a yoke that can straddle the width of a well head flange. In some embodiments, flange plates 76 can further comprise pin holes 77 for attaching torque arm 18 to a well head flange. In some embodiments, torque arm plate 70 can comprise one or more ram attachment holes 72 for attaching torque arm cylinder 28 thereto, and knuckle 79 configured for contacting and applying force to a well head flange.

Figure 9:
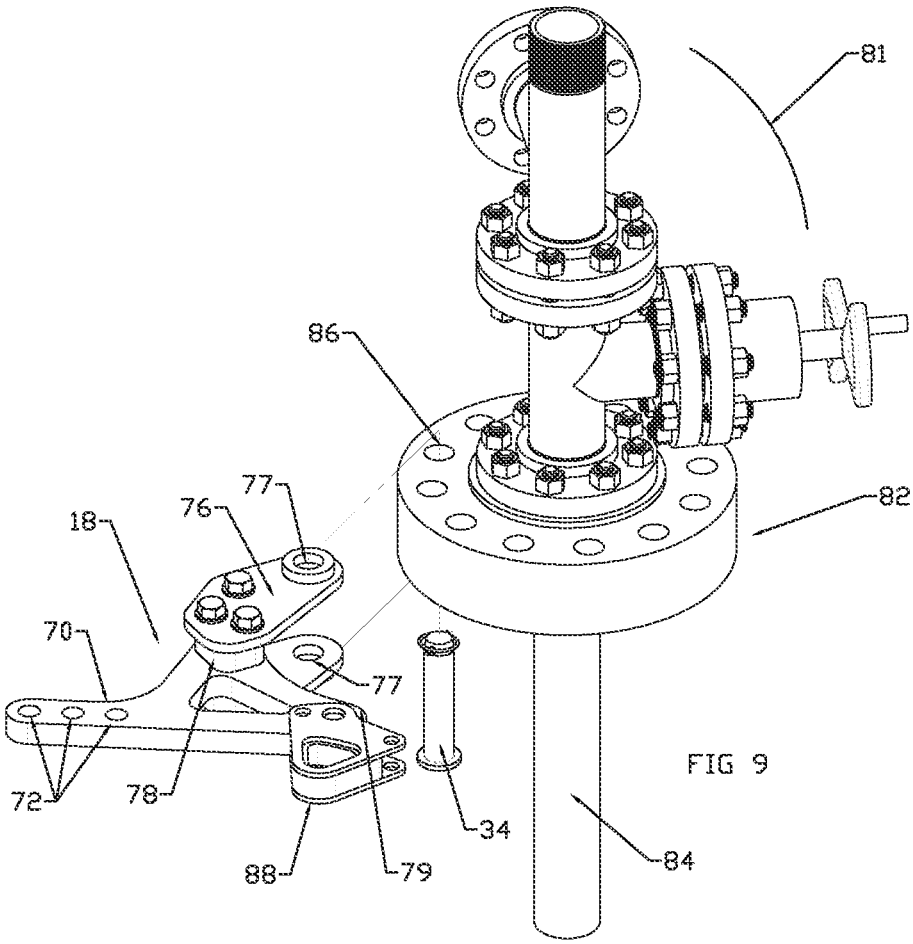
FIG. 9 is a perspective view depicting the torque arm of FIG. 8 being installed on a well head.
Figure 10:
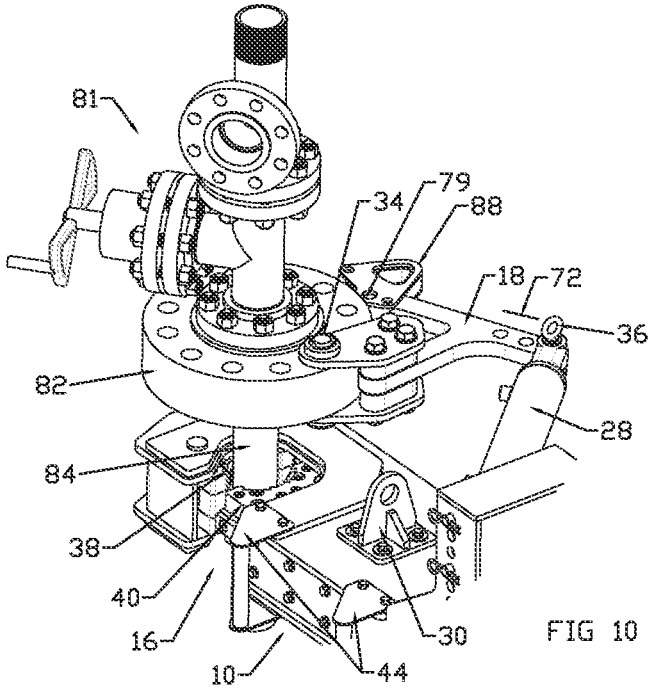
FIG. 10 is a perspective view depicting the well head wrench of FIG. 1 being attached to the torque arm and well head of FIG. 9 for a first pass in turning the well head off of the pipe shown therein.
Figure 11:
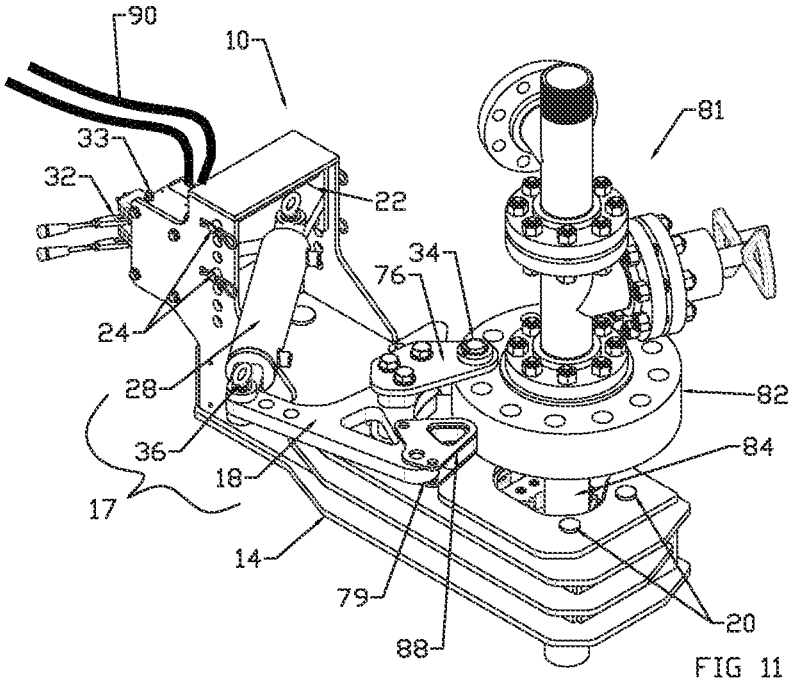
FIG. 11 is a perspective view depicting the well head wrench of FIG. 10 configured for a second pass in turning the well head off of the pipe.
Figure 12:
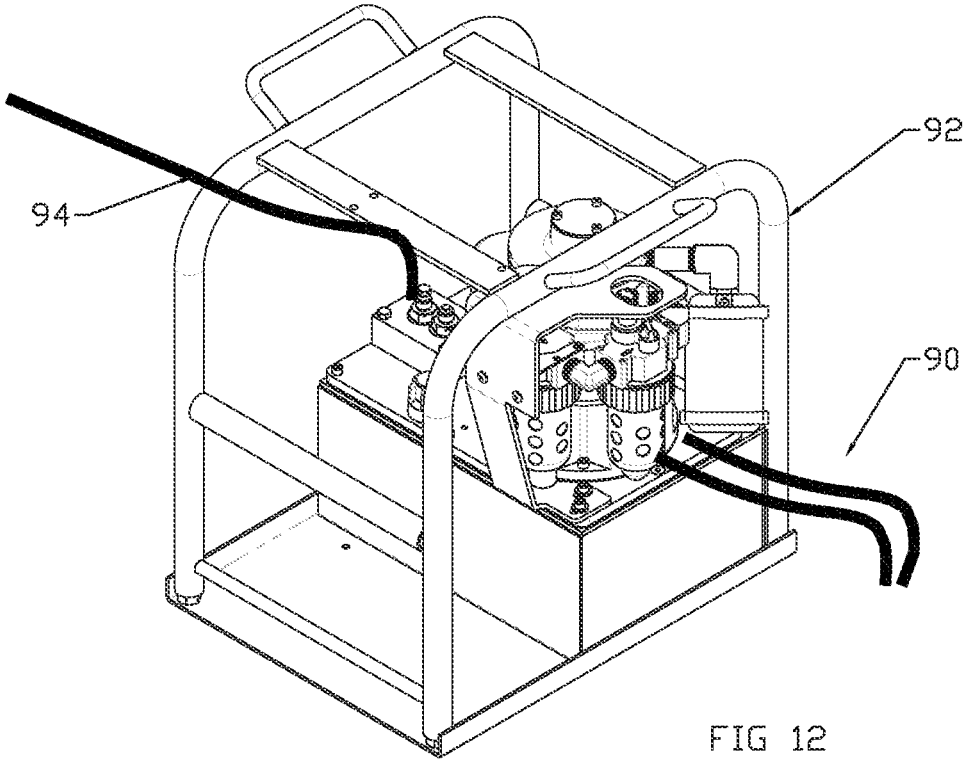
FIG. 12 is a perspective view depicting an air-driven hydraulic unit for operating the well head wrench of FIG. 1.

In operation well head wrench 10 can be used to remove a well head from a well pipe. Referring to FIGS. 9 to 11, the operation of well head wrench 10 can be described as follows. Referring to FIG. 9, well head flange 82 can be removed from pipe 84 by first attaching torque arm 18 to well head flange 82. This can be accomplished by placing flange plates 76 above and below well head flange 82 and inserting flange pin through holes 77 and bolt holes 86 disposed through well head flange 82, and securing flange pin 34 thereto. It should be obvious to those skilled in the art that the thickness of spacer 78 can be selected in order to set the distance between flange plates 76 to be the same as the thickness of well head flange 82.

Referring to FIG. 10, well head wrench 10 can be operated to place pipe 84 in jaw 16 between fixed jaw 38 and sliding jaw 40. This can be accomplished by supporting well head wrench 10 by a crane or lift or cable (not shown) attached to lifting lug 30. An operator can maneuver well head wrench by moving well head wrench 10 with handles 44 so that pipe 84 is disposed within jaw 16. Cylinder 28 then can be attached to torque arm 18 by placing torque arm pin 36 through one of the attachment holes 72 disposed through arm plate 70. Upon attaching cylinder 28 to torque arm 18, an operator can operate hydraulic controls 32 of well head wrench 10 to close jaw 16 against pipe 84. This involves operating the lever on hydraulic controls 32 that can actuate cylinder 46 to extend and move sliding jaw 40 towards pipe 84 to secure pipe 84 in jaw 16. An operator can then operate hydraulic controls 32 to extend cylinder 28 to rotate torque arm 18 about flange pin 34 until knuckle 79 contacts well head flange 82 to apply force thereto. As cylinder 28 extends, this can cause torque arm 18 to impart a rotational force on well head flange 82 to rotate it counter-clockwise relative to pipe 84 and thereby loosen the threaded connection between well head flange 82 and pipe 84. Once cylinder 28 has extended fully, an operator can retract cylinder 28 back to a fully closed position. In some embodiments, torque arm 18 can comprise flange block 88 rotatably attached to knuckle 79, wherein flange block 88 can be configured to contact and apply force to well head flange 82. Referring to FIG. 11, flange block 88 can be rotated on torque arm 18 such that it can contact well head flange 82. Ram 28 can then be extended a second time to rotate torque arm 18 to contact and apply force to well head flange 82 to further rotate it counter-clockwise relative to pipe 84. At this point, torque arm pin 36 can be removed to disengage torque arm 18 from cylinder 28. An operator can then retract cylinder 28 and, in addition, retract cylinder 46 to loosen jaw 16 from pipe 84 such that well head wrench 10 can be moved away from well head 81. An operator can now then use torque arm 18 as a handle or lever to continue removing well head flange 82 manually from pipe 84. Once the threaded connection between well head flange 82 and pipe 84 has been loosened to the point that well head flange 82 can be manually unthreaded from pipe 84, flange pin 34 can be removed to remove torque arm 18 from well head flange 82.

In the description of the operation of well head wrench 10 above, it was presumed that the threads of well head flange 82 and pipe 84 were conventional right-handed threads. It is obvious to those skilled in the art that well head wrench 10 can be configured to undo reverse or left-handed threaded connections between flange 82 and pipe 84 by flipping torque arm 18 over and moving torque arm cylinder 28 to the left of jaw 16 when viewed from above, as opposed to being on the right of jaw 16 as shown in the figures herein.

Furthermore, the description above describes cylinders 28 and 46 as comprising hydraulically-operated cylinders. In some embodiments, cylinders 28 and 46 can comprise pneumatically-operated cylinders with the additional hardware necessary for their operation as obvious to those skilled in the art.

To operate well head wrench, a pressurized hydraulic fluid supply system, as obvious to those skilled in the art, can be used. In some embodiments, air-driven hydraulic unit 92 can be used to supply pressurized hydraulic fluid via send and return hydraulic hoses 90 connected to hydraulic connections 33 disposed on hydraulic controls 32 of well head wrench 10. In some embodiments, hydraulic unit 92 can be powered by a supply of compressed air, as normally provided on a drilling rig, via air hose 94. In other embodiments, hydraulic unit 92 can be an electrically powered unit to provide pressurized hydraulic fluid to well head wrench 10. In further embodiments, the pressurized hydraulic fluid supply system can be substituted with a pressurized air supply system if cylinders 28 and 46 comprise pneumatically-operated cylinders, as well known and obvious to those skilled in the art.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. A method for unthreading a well head flange from a pipe, the method comprising the steps of:

a) providing a wrench further comprising;

i) a frame further comprising a pipe jaw configured for gripping the pipe beneath the well head flange, ii) means for operating the pipe jaw to grip and release the pipe, iii) a torque arm assembly pivotally attached to the frame, the torque arm assembly configured to rotate the well head flange relative to the pipe when the jaw is gripping the pipe, the torque arm assembly further comprising a torque arm configured to pivotally and releasably attach to the well head flange, and iv) a first telescoping member disposed between the torque arm assembly and the torque arm for applying force to the torque arm to rotate the well head flange relative to the pipe, whereupon extending the first telescoping member causes the torque arm to apply force to rotate the well head flange when the torque arm is pivotally attached to the well head flange, and whereupon retracting the first telescoping member causes the torque arm to stop applying force to the well head flange;

b) placing the wrench in proximity to the pipe and gripping the pipe with the pipe jaw;

c) attaching the torque arm to the well head flange;

d) attaching the torque arm assembly to the first telescoping member; and e) applying force to the torque arm to rotate the well head flange relative to the pipe.

2. The method as set forth in claim 1, further comprising the steps of:

a) retracting the torque arm from the well head flange;

b) rotating a flange block disposed on the torque arm wherein the flange block is configured to contact and apply force to the well head flange; and c) applying force to the torque arm to rotate the well head flange relative to the pipe.

3. The method as set forth in claim 1, wherein the pipe jaw further comprises a fixed jaw disposed in the frame, and a sliding jaw slidably disposed in the frame and configured to slide within the frame towards and away from the fixed jaw to grip and release the pipe.

4. The method as set forth in claim 3, wherein each of the fixed jaw and the sliding jaw comprises at least one die insert plate, the at least one die insert plate configured for receiving and retaining at least one replaceable pipe die configured for gripping the pipe.

5. The method as set forth in claim 4, wherein each of the fixed jaw and the sliding jaw comprises two die insert plates.

6. The method as set forth in claim 1, wherein the means for operating the pipe jaw comprises a second telescoping member disposed in the frame, the second telescoping member further comprising a first end operatively coupled to the frame and a second end operatively coupled to the sliding jaw whereupon extending the second telescoping member causes the sliding jaw to move towards the fixed jaw, and whereupon retracting the second telescoping member causes the sliding jaw to move away from the fixed jaw.

7. The method as set forth in claim 6, wherein the second telescoping member further comprises one or more from a group consisting of a hydraulically-operated cylinder and a pneumatically-operated cylinder.

8. The method as set forth in claim 1, wherein the torque arm further comprises a yoke configured for releasable and rotatable attachment to the well head flange.

9. The method as set forth in claim 8, wherein the torque arm further comprises a knuckle configured for contacting and applying force to the well head flange.

10. The method as set forth in claim 1, wherein the second first telescoping member further comprises one or more from a group consisting of a hydraulically-operated cylinder and a pneumatically-operated cylinder.

11. The method as set forth in claim 1, wherein the wrench further comprises means for powering the means for operating the pipe jaw and the first telescoping member for applying force to the torque arm.

12. The method as set forth in claim 11, wherein the powering means further comprises one or more from a group consisting of a pressurized hydraulic fluid supply system and a pressurized air supply system.

* * * * *